US010758790B2

(12) United States Patent
Jertson et al.

(10) Patent No.: US 10,758,790 B2
(45) **Date of Patent: *Sep. 1, 2020**

(54) GOLF CLUB HEAD INCLUDING IMPACT INFLUENCING FLEXTURE JOINT

(71) Applicant: KARSTEN MANUFACTURING CORPORATION, Phoenix, AZ (US)

(72) Inventors: Martin R. Jertson, Phoenix, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/354,042

(22) Filed: Mar. 14, 2019

(65) Prior Publication Data

US 2019/0209901 A1 Jul. 11, 2019

Related U.S. Application Data

(63) Continuation of application No. 15/819,257, filed on Nov. 21, 2017, now Pat. No. 10,279,225.

(60) Provisional application No. 62/242,554, filed on Nov. 22, 2016.

(51) Int. Cl.
*A63B 53/04* (2015.01)
*A63B 60/02* (2015.01)

(52) U.S. Cl.
CPC ..... *A63B 53/0466* (2013.01); *A63B 53/04* (2013.01); *A63B 60/02* (2015.10); *A63B 2053/042* (2013.01); *A63B 2053/0408* (2013.01); *A63B 2053/0416* (2013.01); *A63B 2053/0425* (2013.01); *A63B 2053/0429* (2013.01); *A63B 2053/0433* (2013.01)

(58) Field of Classification Search
CPC ..... A63B 53/0466; A63B 53/04; A63B 2053/042; A63B 2053/0425; A63B 2053/0429; A63B 2053/0416; A63B 2053/0433; A63B 2053/0408; A63B 60/02
USPC ..... 473/342, 329, 344, 345, 348, 350, 338
See application file for complete search history.

(56) References Cited

U.S. PATENT DOCUMENTS 4,123,056 A 10/1978 Nakamatsu
5,301,946 A 4/1994 Schmidt et al.
6,299,547 B1 10/2001 Kosmatka
(Continued)

FOREIGN PATENT DOCUMENTS

CN 105344078 A 2/2016
JP 2001346917 A 12/2001
(Continued)

OTHER PUBLICATIONS

Int'l Search Report and Written Opinion of the ISA for corresponding Int'l Application No. PCT/US2017/062712, dated Feb. 5, 2018.

*Primary Examiner* — Benjamin Layno

(57) ABSTRACT

A hollow golf club head includes an inner surface and an outer surface, the golf club head further comprises a strike face operative to impact a golf ball, a body extending rearward from a perimeter of the strike face, and a flexure joint extending from the outer surface to the inner surface. The flexure joint includes a forward impact surface, a reaction surface in contact with the impact surface, and during an impact, the impact surface translates along the reaction surface to permit a controlled deflection of a portion of the strike face.

17 Claims, 8 Drawing Sheets

(56) References Cited

U.S. PATENT DOCUMENTS

| | | | | |
|---|---|---|---|---|
| 6,739,982 | B2 | 5/2004 | Murphy | |
| 7,367,900 | B2 | 5/2008 | Kumamoto | |
| 8,133,128 | B2 * | 3/2012 | Boyd | A63B 53/04 473/288 |
| 8,403,771 | B1 * | 3/2013 | Rice | A63B 53/04 473/328 |
| 8,608,585 | B2 | 12/2013 | Stites et al. | |
| 8,956,242 | B2 | 2/2015 | Rice et al. | |
| 8,986,133 | B2 | 3/2015 | Bennett et al. | |
| 9,199,141 | B2 | 12/2015 | Cardani et al. | |
| 9,320,948 | B2 | 4/2016 | Fossum | |
| 9,474,945 | B2 | 10/2016 | Fossum | |
| 9,492,722 | B2 | 11/2016 | Taylor et al. | |
| 9,504,889 | B2 | 11/2016 | Mitzel et al. | |
| 9,616,300 | B2 | 4/2017 | Motokawa | |
| 9,662,545 | B2 | 5/2017 | Beach et al. | |
| 9,682,290 | B2 | 6/2017 | Shear | |
| 9,993,699 | B2 | 6/2018 | Larson | |
| 10,016,664 | B2 | 7/2018 | Rice et al. | |
| 10,279,225 | B2 * | 5/2019 | Jertson | A63B 53/0466 |
| 2003/0162608 | A1 | 8/2003 | Chen | |
| 2005/0124435 | A1 | 6/2005 | Gambetta et al. | |
| 2006/0116218 | A1 | 6/2006 | Burnett et al. | |
| 2012/0196703 | A1 | 8/2012 | Sander | |
| 2015/0094163 | A1 * | 4/2015 | Motokawa | A63B 53/0466 473/329 |
| 2016/0346633 | A1 | 12/2016 | Akiyama | |
| 2017/0014690 | A1 | 1/2017 | Morin et al. | |
| 2017/0151472 | A1 | 6/2017 | Todd et al. | |
| 2018/0043222 | A1 | 2/2018 | Fossum | |

FOREIGN PATENT DOCUMENTS

| | | | |
|---|---|---|---|
| JP | 2004351173 | A | 12/2004 |
| JP | 2005192706 | A | 7/2005 |
| JP | 2016182356 | A | 10/2016 |
| WO | 201426206 | | 2/2014 |

* cited by examiner

GOLF CLUB HEAD INCLUDING IMPACT INFLUENCING FLEXTURE JOINT

CROSS REFERENCE TO RELATED APPLICATIONS

This is a continuation of U.S. patent application Ser. No. 15/819,257, filed 21 Nov. 2017, now U.S. Pat. No. 10,279,225, which claims the benefit of priority from U.S. Provisional Patent Application No. 62/425,554, filed 22 Nov. 2016, all of which are hereby incorporated by reference in their entirety.

TECHNICAL FIELD

The present invention relates generally to golf club heads having one or more impact-influencing flexural joints proximate to the club face.

BACKGROUND

Modern wood-type golf club heads have been developed to accentuate or improve the performance thereof, such as by removing or rearranging mass to desired locations to adjust the location of the club head's center of gravity, and/or by introducing one or more elements, such as channels or slots, to adjust strikeface response for better golf launch characteristics. Such improvements, however, have to be balanced with the ability of the golf club head to withstand appropriate impact stresses without structural degradation or failures, and the ability to be consistently manufactured to provide consistent impact results.

DETAILED DESCRIPTION

Figure 1:
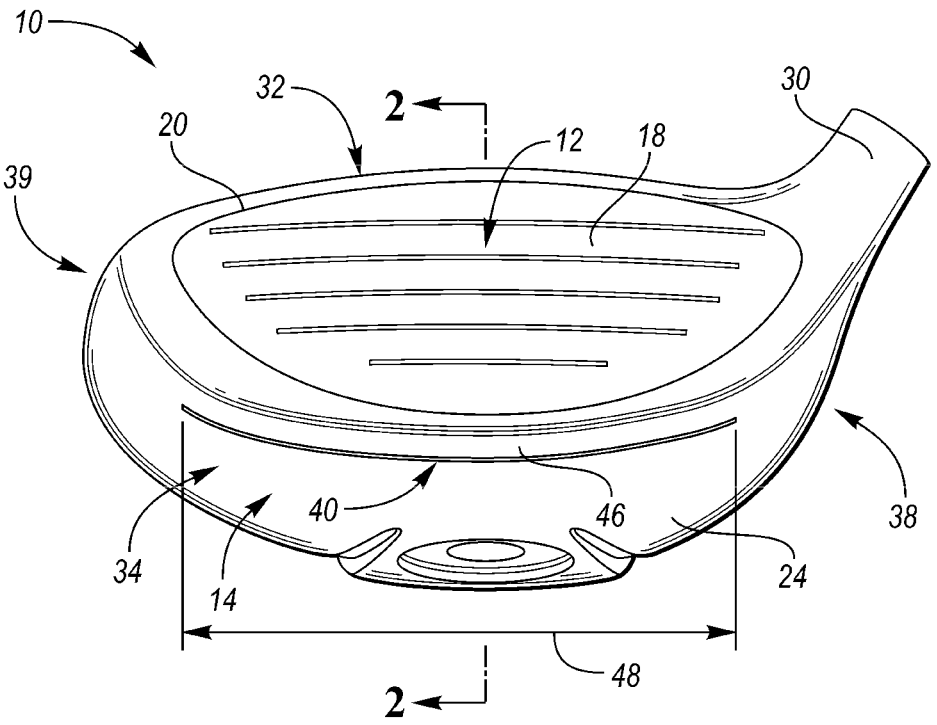
FIG. 1 is a schematic lower front perspective view of an embodiment of a golf club head having a flexure joint.

The present embodiments discussed below are directed to a golf club head having a strike face operative to impact a golf ball, a body extending rearward from a perimeter of the strike face, and a flexure joint extending at least partially through the body proximate to the strike face. The flexure joint is a physical discontinuity in the body, and includes a forward impact surface in contact with a more rearwardly located reaction surface. During an impact, the impact surface and reaction surface translate relative to each other to enable a greater impact deflection in the portion of the face closest to the joint. In a very general sense, the flexure joint decreases the stiffness/body support for a local portion of the face, while permitting a larger amount of elastic strain before fracture. Furthermore, the design of the flexure joint permits an easier means of tuning the stress/strain response that in a comparable design that incorporates a smooth/neat/continuous surface. Tunable joint parameters include, for example, placement, length, orientation, maximum allowable displacement and stress/strain response (via the angle and geometry of the split between the outer surface and inner surface of the body.

In some embodiments that include a flexure joint in the crown, within about 40 mm of, and about parallel to the club face, the club head may launch a golf ball at a loft angle (relative to a horizontal ground plane) that is greater than the indicated, static loft of the club head (measured according to traditional practices). Such an embodiment may also launch the golf ball at a greater spin rate (i.e., about 5-15% greater) than a comparatively designed club head without the flexure joint. Conversely, if the flexure joint is located in the sole, the club head may launch a golf ball at a loft angle that is less than the indicated, static loft of the club head, and at a lower spin rate (i.e., about 5-15% lower) than a comparatively designed club head without the joint.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes with general reference to a golf club held at address on a horizontal ground plane and at predefined loft and lie angles, though are not necessarily intended to describe permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Figure 2:
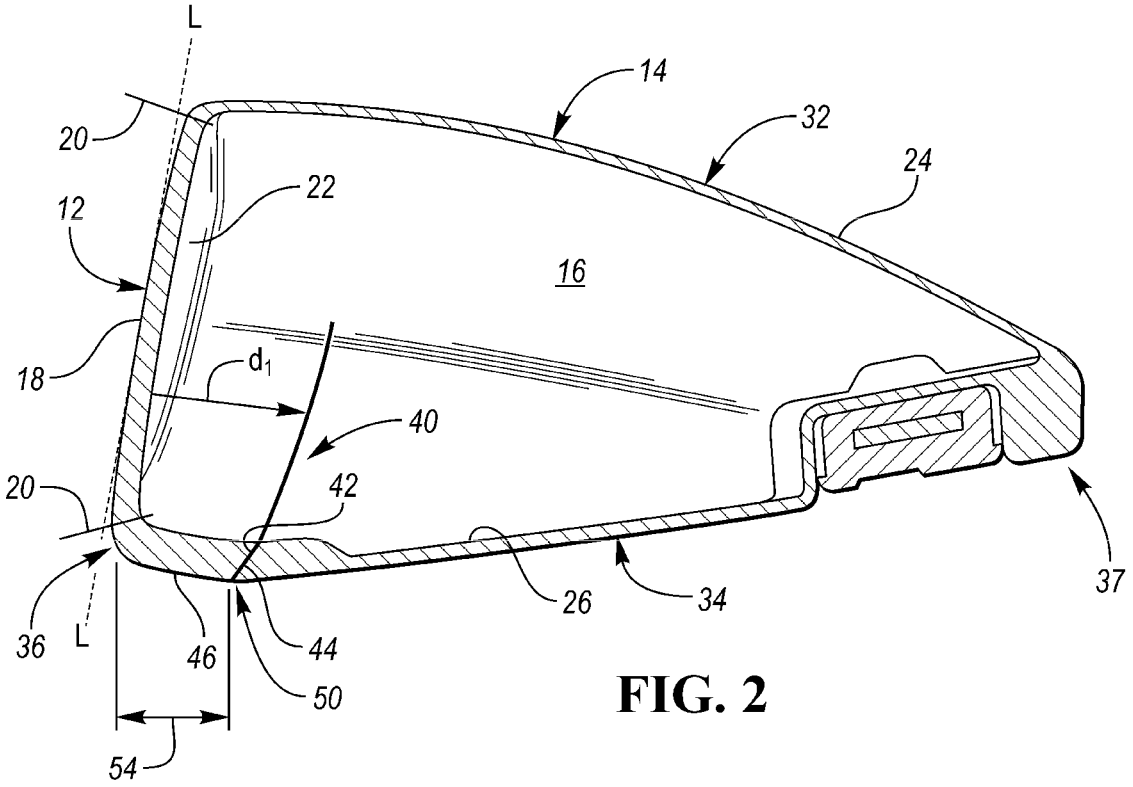
FIG. 2 is a schematic cross-sectional view of the golf club head of FIG. 1, taken along line 2-2.

Referring to the drawings, wherein like reference numerals are used to identify like or identical components in the various views, FIG. 1 schematically illustrates a lower front side view of a golf club head 10 that includes a strike face 12 and a body 14 that cooperate to define a hollow internal club head volume 16, such as shown in FIG. 2.

The strike face 12 ("face 12") includes an outward-facing ball striking surface 18 that is operative to impact a golf ball when the club head is swung in a traditional arcuate manner, an outer perimeter 20, and a rear surface 22 that is opposite the ball striking surface 18. As shown, the ball striking surface 18 is relatively flat, occupying at least a majority of the face 12. The outer perimeter 20 of the face 12 may be defined as the point on the forward portion of the club 36 where the outer profile of the club head 10 first begins to transition from a substantially uniform profile of the ball striking surface 18 rearward into the body 14. Said another way, the outer perimeter 20 may be located at the point where the ball striking surface 18 first deviates from a singular reference plane (exclusive of the profile of any grooves), or where the radius of curvature of the ball striking surface 18 first begins to decrease from an otherwise constant face curvature (i.e., defined by the bulge/roll radius).

The ball striking surface 18 is generally inclined at a static loft angle relative to a ground plane when held at address. When swung in an arcuate manner to impact a stationary golf ball, the dynamics of the club head motion and dynamics of the impact response may launch the impacted golf ball at an initial trajectory angle, relative to the ground plane, that is different from the nominal loft angle for that club. This initial trajectory angle is referred to as the dynamic loft angle. The dynamics of the club head motion and dynamics of the impact response may further influence the amount of spin (i.e., revolutions/minute about a spin axis) that is imparted to the launched ball. The designs described herein are intended to affect the dynamics of the impact response in an effort to influence both dynamic loft and spin rate of an impacted ball.

With reference to FIG. 2, the body 14 is generally the portion of the club head 10 that extends rearward from the perimeter 20 of the strike face 12. The body 14 includes an outer surface 24 that substantially forms the outer contours of the club head 10, and an inner surface 26 that directly abuts the internal volume 16. In general, the present technology may be primarily used with wood-style clubs, including, without limitation, drivers, fairway woods, hybrid irons, rescue clubs, or the like. Common to all of these club styles is a generally thin-walled, shell-like construction that defines a substantially closed internal club head volume 16.

With continued reference to FIGS. 1 and 2, in general, the body 14 may include various aspects including many directionally-defined portions/regions. For example, with a wood-style club, the body 14 includes a hosel 30 that is operative to receive a shaft adapter and/or golf club shaft (not shown), a top portion or crown 32, a bottom portion or sole 34, a front portion 36 abutting the strike face 12, a rear portion 37 opposite the front portion 36, a heel 38 proximate the hosel 30, and a toe 39 opposite the heel 38. In some embodiments, the crown 32 may meet the sole 34 generally at a perimeter line that has a vertical tangent when the club head 10 is held at a prescribed loft and lie angle on a horizontal ground plane.

The face 12, body 14, and hosel 30 may be formed as a single piece, or as separate pieces that may be joined together during an assembly process. Unless otherwise noted, the materials used to form the face 12, body 14, and/or hosel 30 should not be limited to any particular construction. For example, in one embodiment, both the strike face 12 and body 14 may be formed from metal, however, they may each comprise a different metal or alloy and may be joined via a welding process. In another embodiment, the strike face 12 and body 14 may be formed from the same metal. In still another embodiment, the strike face 12 and the front portion 36 of the body 14 may be formed from one or more metals, while a majority of the remainder of the body 14 may be formed from a different metal, or even a polymer that is then adhered to the front portion 36.

In general, the present golf club head 10 includes one or more impact-influencing features on the body 14 or between the body 14 and the face 12 that are operative to affect the launch properties of a golf ball following an impact by the face 12. In the present designs, the impact-influencing feature may include one or more flexure joints 40 that are designed to provide increased or altered dynamic bending/flexure of strike face 12 during an impact. As will be discussed below, the flexure joint's effect on the face can improve the performance characteristics of a golf club by influencing ball speed, initial launch angle, and/or ball spin rate, while also providing greater forgiveness for off-center impacts. In general, the shape, location, and maximum allowable deflection of the flexure joint 40 are the main factors in controlling the impact influencing effects of the joint 40.

In a very general sense, the flexure joints described herein permit the face 12 to yield at impact in a more controlled and tunable manner than a comparable neat/smooth body design. If the face 12 is approximated as a rigid body, a flexure joint 40 may operate much like crumple zone in a car. More particularly, in some embodiments, the flexure joint 40 effectively serves to decrease the buckling stiffness of a portion of the body 14, thus permitting the face to elastically yield during an impact. Such an effect may appear as a variable stiffness around the outer perimeter 20.

In most of the embodiments described below, the flexure joint 40 specifically includes a discontinuity in the club head 10 that enables two adjacent portions of the club head 10 to translate relative to each other in direct response to the impact between a golf ball and the strike face 12. In many of the embodiments, the discontinuity is a physical discontinuity (i.e., where there is a break in the club head 10 that extends from an outer surface (e.g. outer surface 24) clear through to the inner volume 16. In other embodiments, however, this physical discontinuity may be filled by a comparatively softer, elastomeric material, solely for the purpose of inhibiting the ingress of debris or liquid into the internal volume 16. In those embodiments, the physical discontinuity in the club head 10 may more accurately be described as a material discontinuity.

In general, the flexure joint 40 may comprise a forward impact surface 42 that is in slidable contact with a more rearwardly located reaction surface 44. The forward impact surface 42 may be rigidly coupled to the ball striking surface 18 through a metallic separation portion 46. When the strike face 12 contacts a ball, the resulting impact forces urge the face 12 to flex inwardly/toward the rear portion 37 of the club head 10. The impact forces may propogate from the face 12, through the separation portion 46, and to the impact surface 42 of the flexure joint 40. Due to the discontinuity in the club head 10 and the geometry of the joint 40, the transmitted impact forces may cause the impact surface 42 to elastically translate along the reaction surface 44. This relative surface translation may then cause a resulting transverse elastic strain in the body 14 as the reaction surface 44 is urged out of the way. Much in the same way that the ball elastically compresses and then rebounds during an impact, a similar rebound may then occur across the flexure joint 40. More specifically, following the initial elastic loading, the reaction surface 44 may then unwind its elastic strain (and/or the strain experienced by the coupled portion of the body) back to the impact surface 42 and urge the face 12 to return to its original position.

In some embodiments, the flexure joint 40 may have the practical effect of changing the dynamic loft of the ball striking surface during an impact (i.e., relative to the static loft of the club head 10), while also affecting the amount of spin imparted to the ball. These effects are generally attributed to a non-uniform flexing/displacement of the face 12 caused by the body's non-uniform buckling stiffness around the perimeter 20 of the face 12 (i.e., where the physical discontinuity of the joint 40 results in a comparatively lower stiffness near the joint than in portions more distal to the joint 40). This non-uniform flexing/displacement of the face 12 then has the operative effect of re-orienting the ball striking surface 18 at impact. For a club head 10 with a single joint 40, if the joint 40 is located in the sole 34, the ball striking surface 18 may be dynamically delofted at impact (relative to the nominal static loft) and comparatively less spin would be imparted to the ball; conversely, if the joint 40 is located in the crown 32, the loft may be dynamically increased at impact and comparatively more spin would be imparted to the ball.

By allowing the face 12 to flex/displace more at impact, the flexure joint 40 may also result in a smaller degree of deformation of the ball as compared to a traditional head. Such an impact response may assist in achieving greater impact efficiency and greater energy and velocity transfer to the ball during impact. Depending on the natural frequencies of the ball and face, the flexure joint 40 and increased face motion may also cause a change in the impact time (i.e., the time that the ball is in contact with the ball striking surface 18 during an impact). In general, longer impact times can tend to result in greater energy and velocity transfer to the ball during impact. If the frequency responses of the ball and face are adequately matched, the constructive resonance may result in an increased "trampoline" effect, which can result in greater energy and velocity transfer to the ball during impact.

Figure 3:
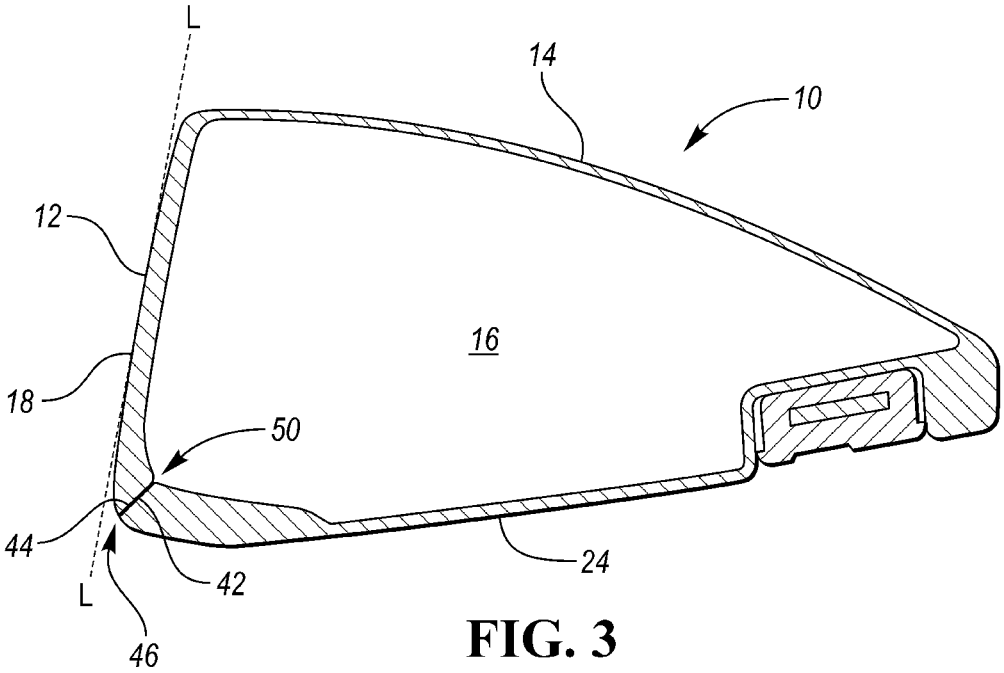
FIG. 3 is a schematic cross-sectional view of an embodiment golf club head having a flexure joint.

As noted above, the location and orientation of the joint 40 has a noticeable impact on its ultimate effect. In most of the examples described herein, the flexure joint 40 is located sufficiently close to the strike face 12 to permit impact forces to be more readily or directly received at the forward impact surface 42 and to enable better deflection of ball striking surface 18. In some embodiments, the forward-most portion of the joint, at each point across the length 48, may be positioned within a particular maximum tolerance or distance $d_1$ of the face 12 and/or of a loft plane L that is a best fit of the ball striking surface 18. In some embodiments, this maximum tolerance $d_1$ may be up to about 50 mm, about 49 mm, 48 mm, 47 mm, 46 mm, 45 mm, 44 mm, 43 mm, 42 mm, 41 mm, 40 mm, 39 mm, 38 mm, 37 mm, 36 mm, 35 mm, 34 mm, 33 mm, 32 mm, 31 mm, 30 mm, 29 mm, 28 mm, 25 mm, 24 mm, 23 mm, 22 mm, 21 mm, or 20 mm. In some embodiments, this maximum tolerance $d_1$ may be up to about 40 mm, or up to about 30 mm. In some embodiments, such as generally shown in FIG. 3, the maximum tolerance $d_1$ may be about 0 mm, or from about 0 mm to about 5 mm. In some embodiments, the forward-most portion of at least a portion of the length of the flexure joint 40 may be located forward of the hosel 30 (as defined by a vertical plane containing the longitudinal axis of the hosel/shaft when the club head is held at prescribed loft/lie angles on a horizontal ground plane).

The flexure joint 40 may generally be oriented such that it is about parallel to the nearest portion of the outer perimeter 20 of the face 12. For example, if the flexure joint 40 is located in the sole 34, the joint 40 may be about parallel to a portion of the perimeter 20 that is directly adjacent to the sole 34. Conversely, if the flexure joint 40 is located in the crown 32, the joint 40 may be about parallel to a portion of the perimeter 20 that is directly adjacent to the crown 32. Due to the complexities presented with a club head having a variable curvature, the term "about parallel" is generally intended to mean that all points along the joint 40 (e.g., along a line where the joint 40 meets the outer surface 24) are within a particular tolerance of some nominal distance from the closest respective location of the perimeter. In an embodiment, the tolerance may be about +/−20 mm, +/−19 mm, +/−18 mm, +/−17 mm, +/—16 mm, +/—15 mm, +/−14 mm, +/−13 mm, +/−12 mm, +/−11 mm, +/−10 mm, +/−9 mm, +/−8 mm, +/−7 mm, +/−6 mm, +/−5 mm, +/−4 mm, +/−3 mm, +/−2 mm, or +/−1 mm. In an alternative definition, the term "about parallel" is generally intended to mean that a best fit line through the joint 40 (e.g., a best fit line through the portion of the joint where the discontinuity meets the outer surface 24) is within a certain angular tolerance of the loft plane L. In an embodiment, the angular tolerance may be about +/−20 degrees, +/−19 degrees, +/−18 degrees, +/−17 degrees, +/−16 degrees, +/−15 degrees, +/−14 degrees, +/−13 degrees, +/−12 degrees, +/−11 degrees, +/−10 degrees, +/−9 degrees, +/−8 degrees, +/−7 degrees, +/−6 degrees, +/−5 degrees, +/−4 degrees, +/−3 degrees, +/−2 degrees, or +/−1 degree.

Orienting the joint 40 in a more parallel relationship to the strike face 12 may have the effect of providing a more uniform face deflection from heel 38 to toe 39 at impact, as the deflection increases generally as the joint 40 is brought closer to the face 12. In some embodiments, a slight skew (within the tolerances above) may be incorporated to provide a draw-biased or fade-biased dynamic response. Likewise, in some embodiments, more centrally located portions of the joint 40 may be closer to the face 12 than portions that are closer to the heel/toe (i.e., the joint 40 may have a convex curvature when viewed from the face 12). Such a front-to-back/convex joint curvature may enable more flexing for impacts nearest the geometric center of the face 12, while providing a stiffer response for off-center impacts.

In addition to the orientation of the joint, the length 48 of the joint 40, measured along the outer surface 24 may affect the nature of the club's impact response. Increasing the length 48 of the flexure joint 40 permits increased deflection of the strike face 12 at impact, which may improve ball launch performance. Additionally, when the flexure joint 40 is located in the sole 34 or the crown 32, and increased length can achieve increased energy and velocity transfer to the ball for impacts that are away from the center or traditional "sweet spot" of the face 12. In most embodiments, the flexure joint 40 may have a length 48 of from about 25 mm to about 125 mm, or from about 50 mm to about 100 mm, or from about 25 mm to about 30 mm, 30 mm to 40 mm, 40 mm to 50 mm, 50 mm to 60 mm, 60 mm to 70 mm, 70 mm to 80 mm, 80 mm to 90 mm, 90 mm to 100 mm, 100 mm to 110 mm, 110 mm to 120 mm, or 120 mm to 130 mm.

As noted above the maximum amount of deflection for a typical impact is also a factor in controlling the nature of the impact response. If the maximum deflection to too large, the face 12 may still be deforming rearward as the ball rebounds off of the ball striking surface 18. This may cause a more drastic change to the dynamic loft, while also transferring less energy back to the ball, resulting in less ball speed. In a design with a comparatively lower maximum amount of deflection, the club face may reach its point of maximum deflection closer to the point where the ball experiences maximum compression. In such an instance, the face and ball may both rebound together (i.e., constructive resonance), thus resulting in greater energy transfer to the ball.

Figure 4:
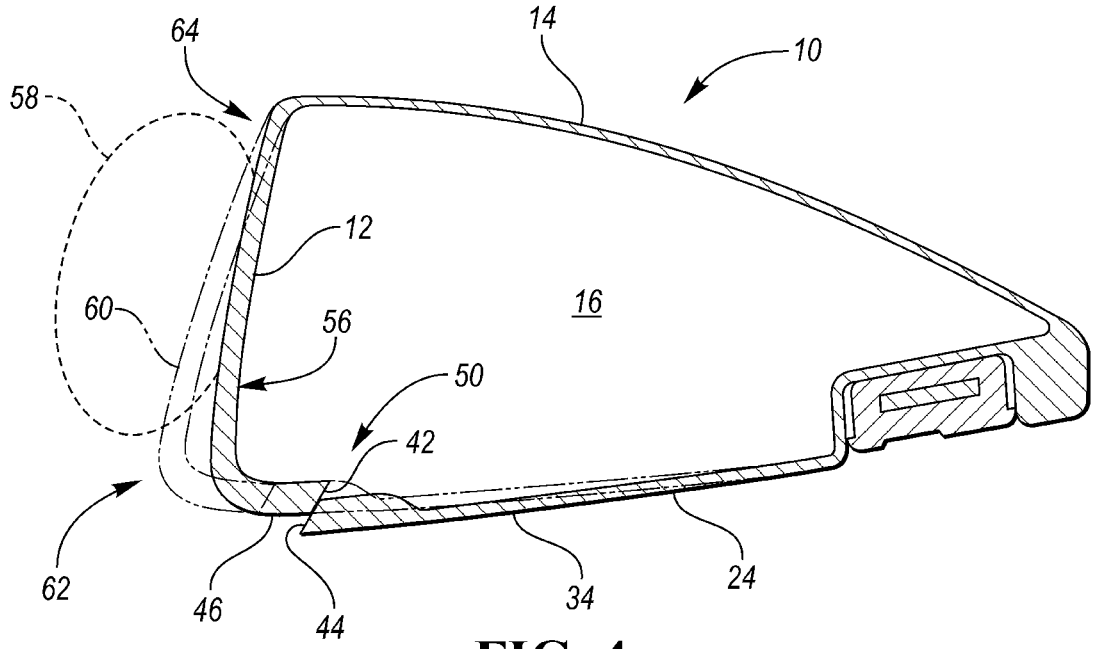
FIG. 4 is a schematic partial cross-sectional view of the golf club head of FIG. 2, shown in a deformed and undeformed state.
Figure 7:
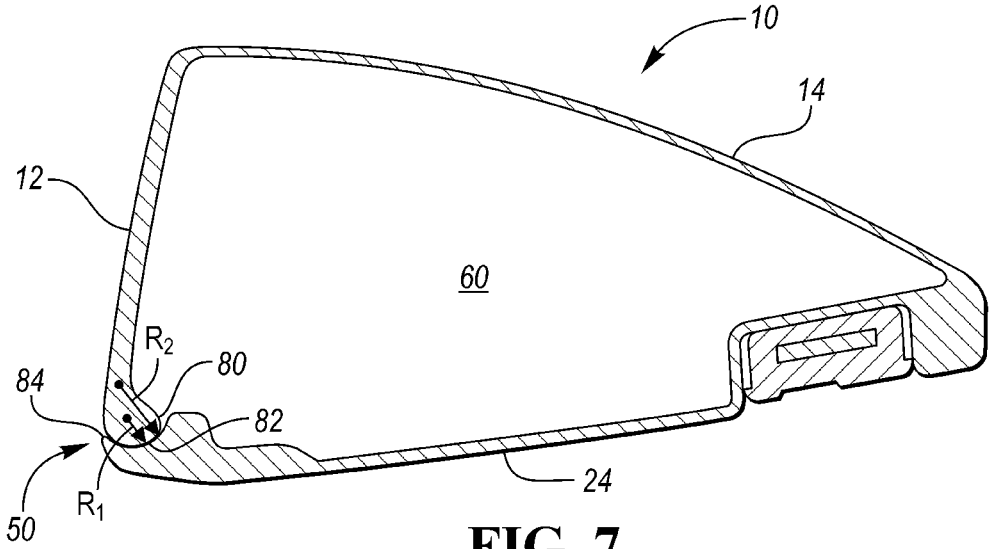
FIG. 7 is a schematic cross-sectional view of an embodiment golf club head having a ball and socket-type flexure joint.
Figure 8:
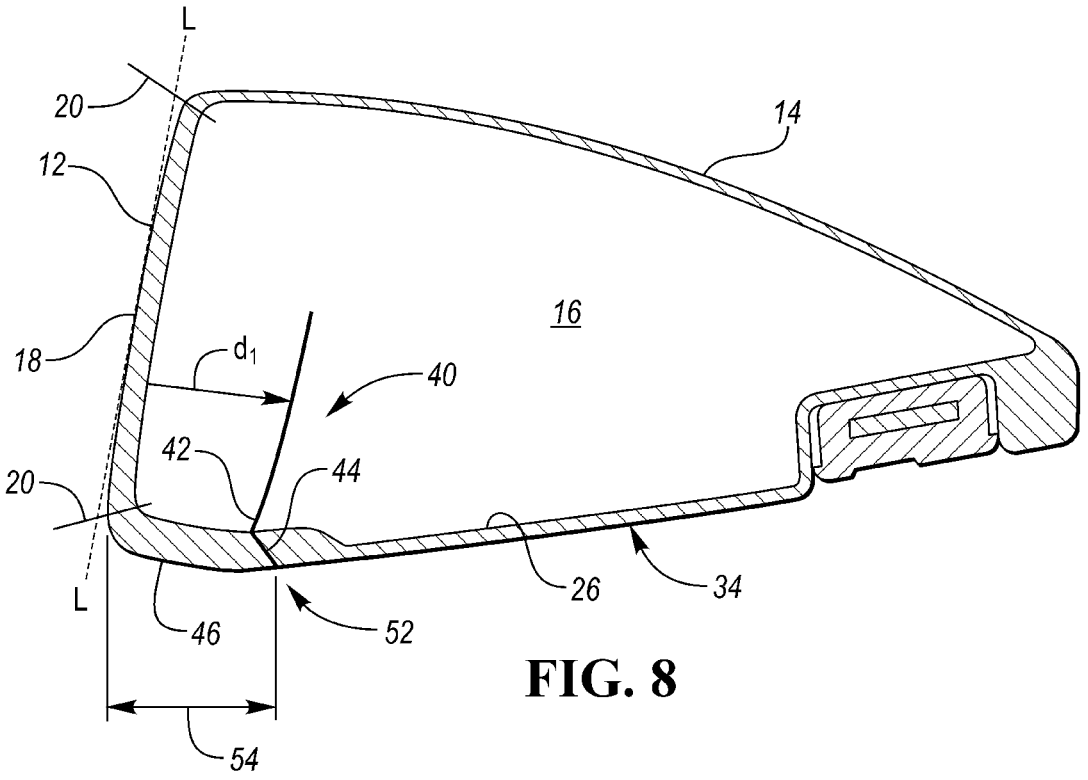
FIG. 8 is a schematic cross-sectional view of an embodiment golf club head with a flexure joint.
Figure 9:
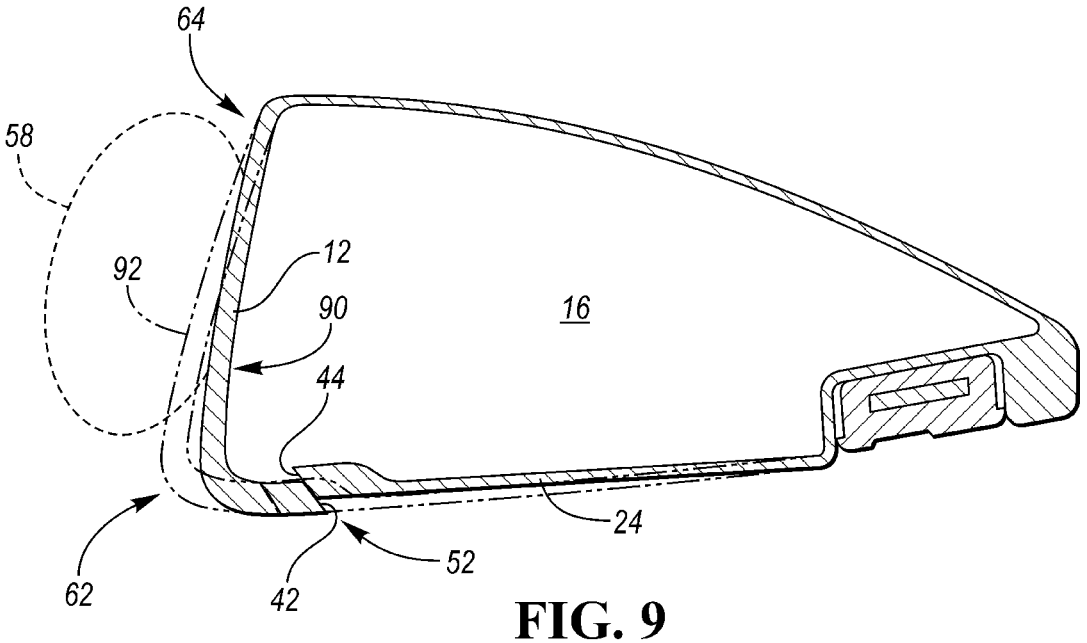
FIG. 9 is a schematic partial cross-sectional view of the golf club head of FIG. 8, shown in a deformed and undeformed state.

FIGS. 2-12 illustrate variations on two different embodiments of a flexure joint 40 that may provide a modified impact response to the club face 12. In FIGS. 2-7, a first flexure joint 50 is illustrated that generally slopes from the outer surface 24 toward the rear portion 37 of the club head 10. FIGS. 8-12 then show an example of a second flexure joint 52 that generally slopes from the outer surface 24 toward the strike face 12. In each case, such as generally shown in FIGS. 4 and 9, during an impact, the impact surface 42 will tend to locally translate along the reaction surface 44, which may cause a corresponding elastic displacement of the reaction surface 44 and rearward body 14. It should be noted that, unless otherwise stated, a "translation of the impact surface 42 along the reaction surface 44" is a description of a relative change in position between the two surfaces and is not necessarily meant to imply any particular motion of the impact surface 42 with respect to other portions of the club head 10.

FIGS. 2 and 3 generally illustrate two club head designs that have differently sized separation portions 46 between the face 12 and the first flexure joint 50. More particularly, the separation portion 46 in FIG. 2 may have a nominal width 54 between the most adjacent perimeter 20 of the strike face 12 and where the joint 40, impact surface 42, and/or reaction surface 44 meets the outer surface 24 of from about 5 mm to about 50 mm, or from about 10 mm to about 40 mm, or even from about 20 mm to about 30 mm. Conversely, the embodiment illustrated in FIG. 3 provides a separation portion 46 having a negligible width and/or a width of from about 0 mm to about 5 mm. Said another way, the flexure joint 50 shown in FIG. 3 meets the outer surface 24 approximately at the outer perimeter 20 of the strike face 12 and/or on or very near to the loft plane L.

As noted above, FIG. 4 generally illustrates the flexure joint 50 of FIG. 2 in a deformed state 56 during an impact between the face 12 and a golf ball 58 (the undeformed state 60 is shown in phantom). As shown, the portion 62 of the face 12 closest to the flexure joint 50 may experience the greatest deformation, while the portion 64 of the face 12 more distant from the joint 50 may experience a comparatively lower amount of deformation. As generally illustrated, the impact surface 42 of the joint 50 may arc in a rearward direction, which may cause the reaction surface 44 to elastically deform outward due to the angle of the joint 40. To accomplish this response, the reaction surface 44 should meet the outer surface at an oblique angle that is large enough to impede the impact surface 42 during an impact. If the angle were too shallow in the joint of FIG. 4, the face 12 may have a portion that is entirely unsupported during an impact, which may present other design challenges. In one embodiment, the reaction surface should include a portion that forms an angle of from about 30 degrees to about 70 degrees with the outer surface 24. The maximum deflection limit may be varied by altering this angle. The steeper this angle, the greater the resistance will be (i.e. lower maximum deflection limit), while a shallower angle will lessen the resistance and provide a greater amount of allowable deflection.

Figure 5:
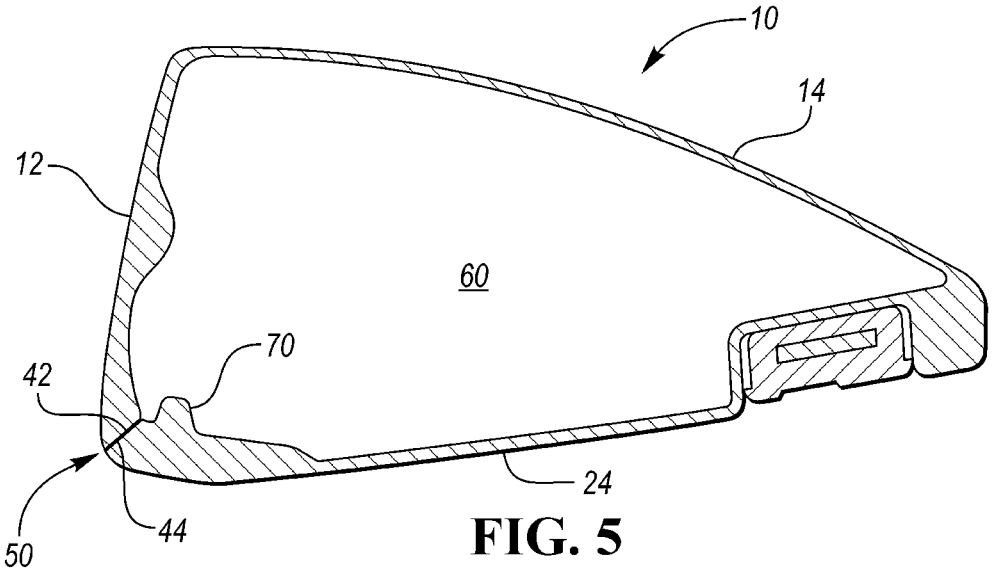
FIG. 5 is a schematic cross-sectional view of an embodiment golf club head having a flexure joint and a mechanical stop to limit deflection of the face.

FIG. 5 shows a similar embodiment as FIG. 3, though with the inclusion of a mechanical stop 70 that is intended to limit the overall translation/displacement of the impact surface 42 relative to the reaction surface 44. Such a design may improve club head durability, and may provide an ultimate fail safe against impacts that are so severe that they may result in a plastic or near-plastic deformation. In some embodiments, this mechanical stop 70 may be adjustable to enable a variable maximum deflection. For example, the mechanical stop 70 may be attached to a screw that can either vary the height of the stop, or permit the stop to be translated and locked along a forward-rearward track.

Figure 6:
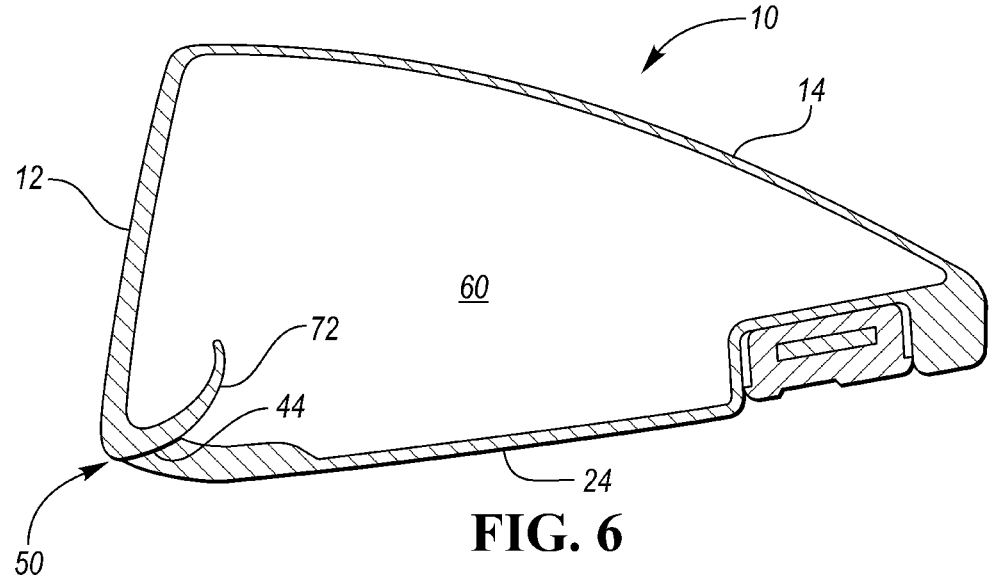
FIG. 6 is a schematic cross-sectional view of an embodiment golf club head having a flexure joint with a curved forward impact surface.

While FIGS. 2-5 generally illustrate a flexure joint 40 that includes two linearly mating surfaces, FIG. 6 generally illustrates a variation having a curved impact surface 72. Curving the impact surface may have the practical effect of lowering contact friction between the impact surface 72 and the reaction surface 44 by reducing the total contact area. This may result in a more efficient elastic force transfer, less energy lost to friction, and a potentially greater deflection for a similar magnitude impact. In some embodiments, such as shown in FIG. 6, the curved impact surface 72 can also impart its own spring characteristics, which may aid in providing a comparatively larger restorative force for a smaller movement of the reaction surface 44. In some embodiments, the radius of curvature may be from about 3 mm to about 40 mm, or from about 10 mm to about 30 mm, or even from about 15 mm to about 25 mm. In some embodiments, the radius of curvature may be about 5 mm to about 10 mm, or about 10 mm to about 15 mm, 15 mm to 20 mm, 20 mm to 25 mm, 25 mm to 30 mm, 30 mm to 35 mm, or 35 mm to 40 mm. Likewise, the radius of curvature may vary across the surface within any of the above-stated ranges. Such an embodiment may likewise be used with a mechanical stop 70, such as shown in FIG. 5.

FIG. 7 generally illustrates an embodiment of a club head 10 with a flexure joint 50 that has both a curved impact surface 80 and a curved reaction surface 82, similar to a ball and socket. While neither surface necessarily has a constant radius of curvature, in general, the curvature of the impact surface 80 is tighter than the curvature of the reaction surface 82. In some embodiments, this may mean that the average radius of curvature $R_1$ of the impact surface 80 is less than the average radius of curvature $R_2$ of the reaction surface 82. For example, $R_1$ may be from about 2 mm to about 25 mm, or from about 5 mm to about 15 mm, or even about 8 mm to about 10 mm, whereas $R_2$ may be from about 6 mm to about 40 mm, or about 10 mm to about 15 mm, so long as $R_2$ is selected to be greater than $R_1$.

By contouring the surfaces in this manner, the face deflection at impact may be more fully tuned. For example, the curvature of the reaction surface 82 may tighten/increase with an increasing distance from the ball striking surface 18. In this manner, the flexure joint 50 may become progressively stiffer with an increasing face deflection. The maximum deflection limit can be altered by raising or lowering the resistance of the impact surface 80 sliding over the reaction surface 82. The faster the curvature of the reaction surface 82 turns vertical, the greater the resistance will be. As further shown in FIG. 7, in some embodiments, a portion 84 of the reaction surface 82 may extend in front of the impact surface 80. Such a design may better provide a smooth forward face of the club head 10 while at rest, and may further constrain any face rebound/overshoot immediately following an impact.

As noted above, FIGS. 8-12 show variations on a second flexure joint 52 that generally slopes from the outer surface 24 toward the strike face 12. The golf club head 10 of FIG. 8 is substantially similar to that illustrated in FIG. 2, with the exception of the differently oriented flexure joint 52. FIG. 9 then illustrates the joint 52 of FIG. 8 in a deformed state 90 during an impact between the face 12 and a golf ball 58 (the undeformed state 92 is shown in phantom). As shown, this geometry may encourage the outer surface 24 of the body 14 to deform or flex inward proximate to the flexure joint 52 (whereas conventional club heads are more inclined to bow outwards in this area at impact). As with the flexure joint illustrated in FIG. 4, the portion 62 of the face 12 closest to the flexure joint 52 may experience the greatest deformation, while the portion 64 of the face 12 more distant from the joint 52 may experience a comparatively lower amount of deformation. As generally illustrated, the impact surface 42 of the joint 52 may generally arc inward at impact, which may cause the reaction surface 44 to relatively translate while also arcing inward.

Figure 10:
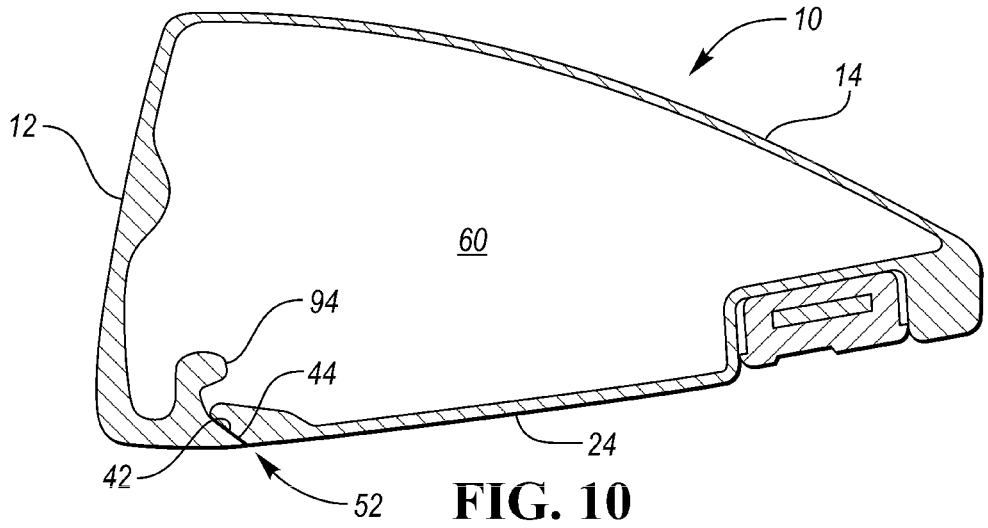
FIG. 10 is a schematic cross-sectional view of an embodiment golf club head having a flexure joint and a mechanical stop to limit deflection of the face.

FIG. 10 shows a similar embodiment as FIG. 8, though with the inclusion of a mechanical stop 94 that is intended to limit the overall translation/displacement of the impact surface 42 relative to the reaction surface 44. Such a design may improve club head durability, and may provide an ultimate fail safe against impacts that are so severe that they may result in a plastic or near-plastic deformation. In some embodiments, this mechanical stop 70 may be adjustable to enable a variable maximum deflection. For example, the mechanical stop 70 may be attached to a screw that can either vary the height of the stop, or permit the stop to be translated and locked along a forward-rearward track.

Figure 11:
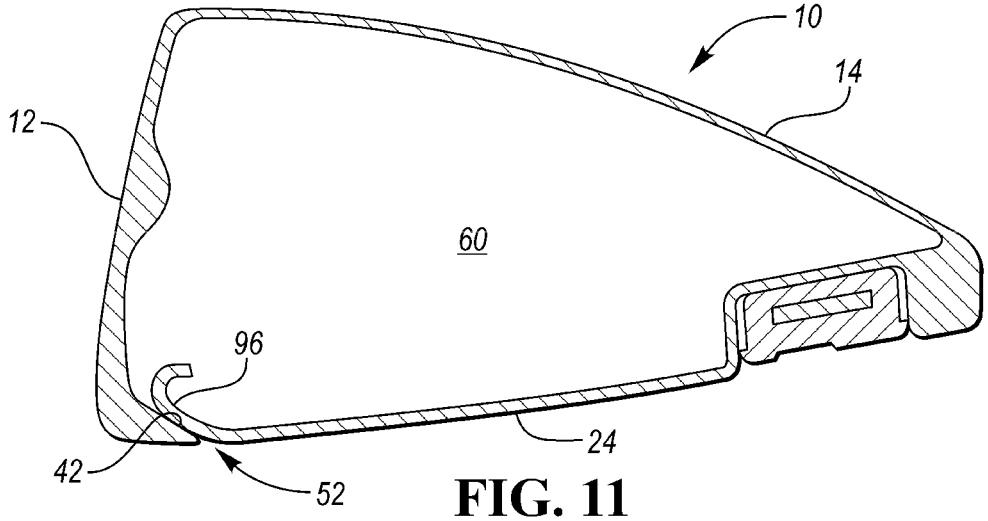
FIG. 11 is a schematic cross-sectional view of an embodiment golf club head having a flexure joint with a curved forward impact surface.

FIG. 11 generally illustrates a similar embodiment as FIG. 8, though with a curved reaction surface 96. Curving the reaction surface 96 may have the practical effect of lowering contact friction between the impact surface 42 and the reaction surface 96 by reducing the total contact area. This may result in a more efficient elastic force transfer, with less energy lost to friction. In some embodiments, such as shown in FIG. 11, the curved reaction surface 96 can also impart its own spring characteristics during the impact, which may aid in providing a comparatively larger restorative force for a smaller movement of the reaction surface 96.

Figure 12:
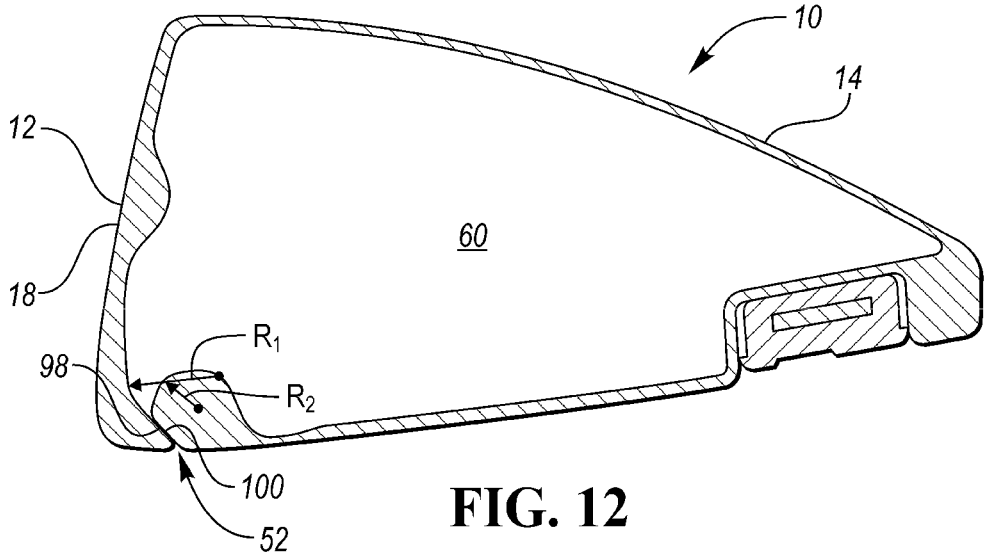
FIG. 12 is a schematic cross-sectional view of an embodiment golf club head having a ball and socket-type flexure joint.

FIG. 12 generally illustrates an embodiment of a club head 10 with a flexure joint 52 that has both a curved impact surface 98 and a curved reaction surface 100. While neither surface necessarily has a constant radius of curvature, in general, the curvature of the reaction surface 100 is tighter than the curvature of the impact surface 98. In some embodiments, this may mean that the average radius of curvature $R_1$ of the impact surface 98 is greater than the average radius of curvature $R_2$ of the reaction surface 100. By contouring the surfaces in this manner, the face deflection at impact may be more fully tuned. For example, the curvature of the impact surface 98 may tighten/increase with decreasing distance from the ball striking surface 18. In this manner, the flexure joint 52 may become progressively stiffer with an increasing face deflection.

Figure 13:
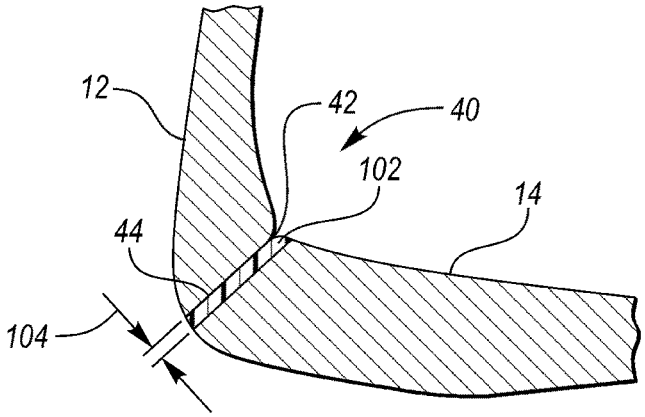
FIG. 13 is a schematic, enlarged cross-sectional view of a flexure joint, similar to the joint illustrated in FIG. 3, having a polymeric coating across the rearward reaction surface.

In some embodiments, one or both of the impact surface 42 and the reaction surface 44 may be coated with a polymer to enhance the durability and performance of the flexure joint 40. More specifically, if both the impact surface 42 and the reaction surface 44 were made from metal, then the repetitive translation between the surfaces may result in galling and/or in the surfaces seizing up. Suitable abrasion resistant polymers may generally be categorized as engineering plastics, and may include polyoxymethylene (POM/Acetal), polytetrafluoroethylene (PTFE), PTFE filled Acetal, polyphenylene sulfide (PPS), and/or certain classes of polyamides such as PA6 or PA66. These classes of polymers may present low surface energy, low friction, durable finishes that may aid the functionality of the present design. Such a polymer layer, while not necessary in all designs, may optionally be utilized any of the designs described herein. FIG. 13 schematically illustrates an embodiment of this polymer layer 102, such as used with a joint 40 similar to that provided in FIG. 3. As shown, the polymer layer 102 may have a thickness 104 measured normal to the joint surface. In some embodiments, the thickness 104 may be from about 0.1 mm to about 5.0 mm or from about 0.2 mm to about 1.0 mm, or from about 0.1 mm to about 0.2 mm, 0.2 mm to 0.4 mm, 0.4 mm to 0.6 mm, 0.6 mm to 0.8 mm, 0.8 mm to 1.0 mm, 1.0 mm to 1.5 mm, 1.5 mm to 2.0 mm, or 2.0 mm to 2.5 mm.

Figure 14:
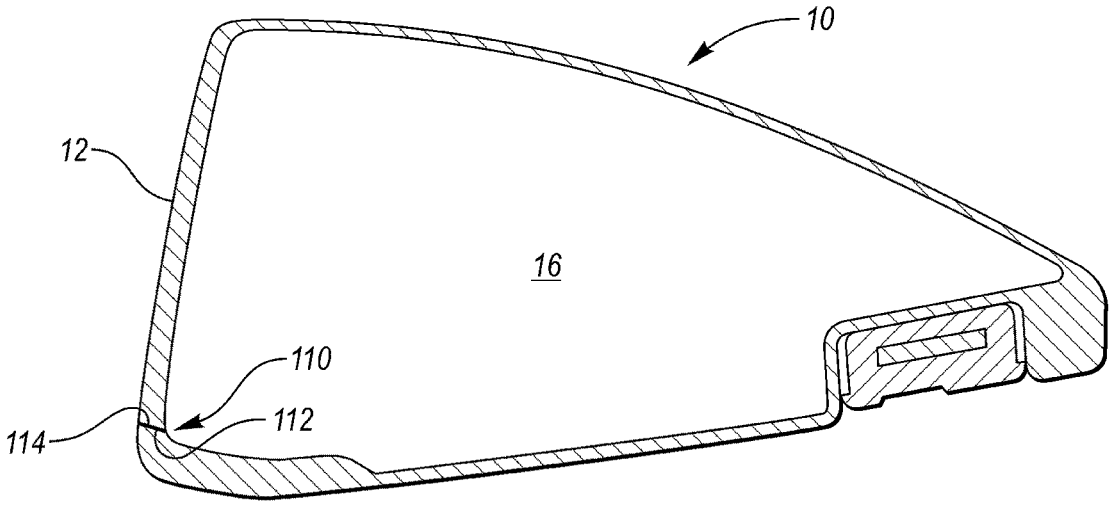
FIG. 14 is a schematic cross-sectional view of an embodiment golf club head with a flexure joint.
Figure 15:
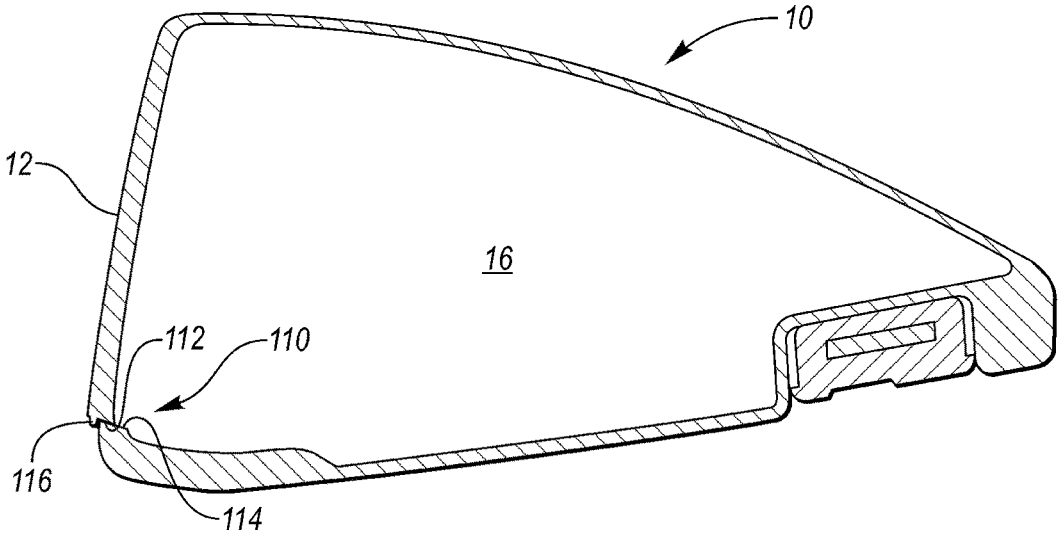
FIG. 15 is a schematic cross-sectional view of an embodiment golf club head with a flexure joint having a mechanical stop.
Figure 16:
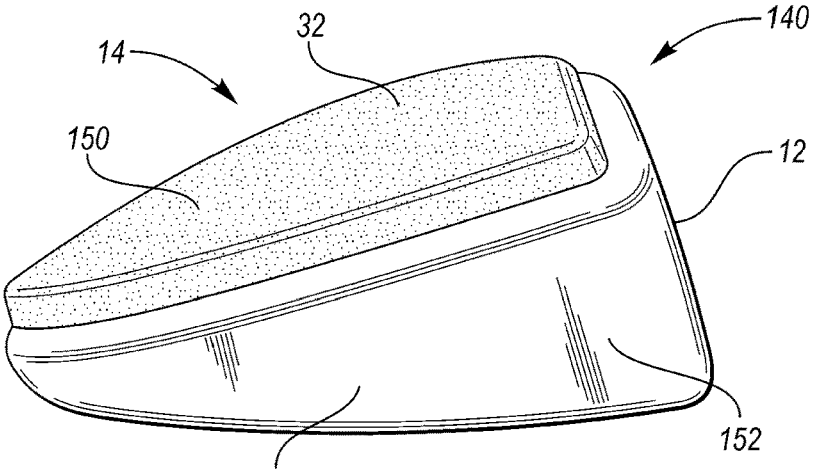
FIG. 16 is a schematic side view of a golf club head having a polymeric crown and reaction wall, and a metallic sole and strike face.

FIGS. 14-15 illustrate an embodiment of a flexure joint 110 whereby the two surfaces of the flexure joint do not directly translate along each other during an impact. Instead, due to the geometric configuration, a more rearwardly located surface 112, in direct communication with the strike face 12, physically separates from a more forwardly located body surface 114 during an impact. In this embodiment, it is preferable for the two surfaces to begin in contact with each other, to prevent liquids or debris from entering the internal volume 16. Such a design relies entirely on the material strength of the face perimeter opposite the joint 110 to limit maximum allowable deformation during an impact. In some embodiments, such as schematically shown in FIG. 14, one or both of the surfaces 112, 114 may include a mechanical stop 116 that prevents or interferes with the ability of the strike face 12 to deflect more than some predetermined intended amount.

FIGS. 16-19 illustrate embodiments of a mixed material club head 140 that incorporates the flexure joint concepts described above, albeit in a slightly different arrangement. More specifically, in these embodiments, the body 14 includes a reaction wall 142 that is in direct and flush contact with the rear surface 22 of the strike face 12. A flexure joint 144 is formed between the face 12 and the reaction wall 142 such that the rear surface 22 of the strike face 12 forms the forward impact surface 42, the front surface of the reaction wall 142 forms the reaction surface 44, and the width/thickness of the face forms the separation portion 46.

As further shown in FIGS. 16-19 the mixed material club head 140 includes a crown 32 and a sole 34, and defines an internal volume 16 between the face 12 and body 14. In these embodiments, the face 12 is integrally formed with one of the crown 32 and the sole 34, while the reaction wall 142 is integrally formed with the other. For example, in the embodiment shown in FIGS. 16-18, the face 12 is integrally formed with the sole 34, and the reaction wall 142 is integrally formed with the crown 32. Conversely, in the embodiment shown in FIG. 19, the face 12 is integrally formed with the crown 32, and the reaction wall 142 is integrally formed with the sole 34.

Figure 18:
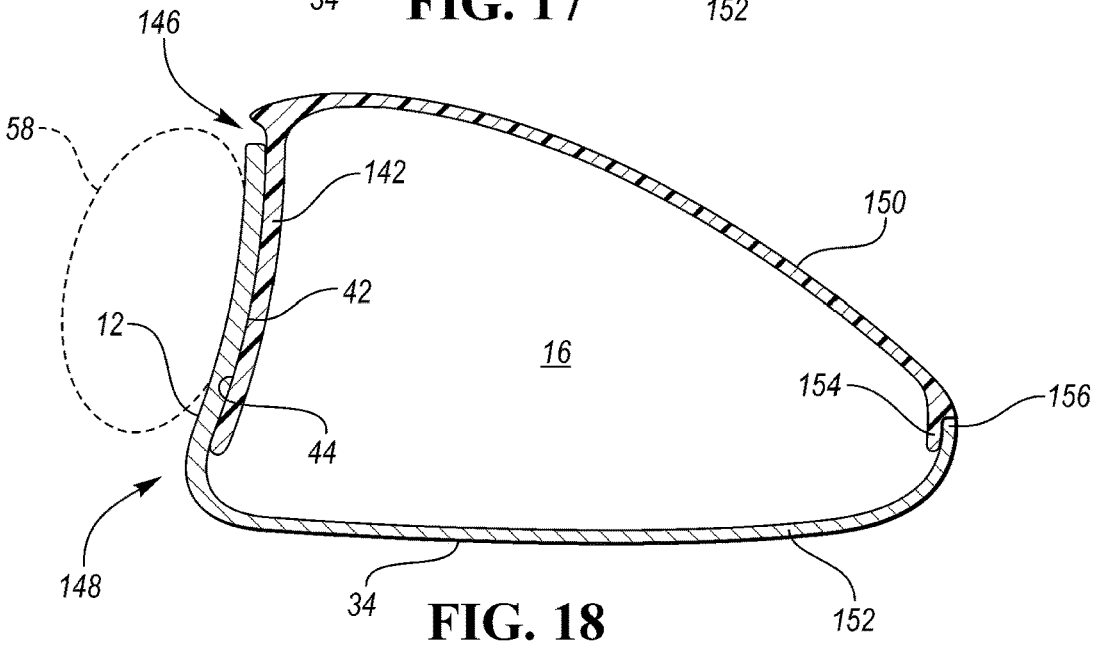
FIG. 18 is a schematic partial cross-sectional view of the golf club head of FIG. 17, shown in a deformed and undeformed state.

During an impact between a golf ball 58 and the strike face 12, such as shown in FIG. 18, the face may deflect inward, with the unsupported/free end 146 deflecting comparatively more than the end 148 that is integrally affixed to the body 14. This deflection of the face 12 generally causes the rear surface 22 of the face 12 to translate along a portion of the reaction surface 44, which may undergo its own elastic deformation in response to the transmitted impact forces. In some embodiments, the reaction wall 142 may cover and/or be in contact with at least about 30% of the area of the rear surface 22 of the strike face. In some embodiments, the reaction wall 142 is in contact with from about 30% to about 60% of the area of the rear surface 22, and in some embodiments, the reaction wall 142 is in contact with from about 50% to about 60% of the area of the rear surface 22.

In one configuration, the face 12 and its integrally formed body portion (i.e., one of the sole 34 and crown 32) are formed from metal, while the reaction wall 142 and its integrally formed body portion (i.e., the other of the sole 34 and the crown 32) is formed from a polymer. Such a configuration may enable a more elastic response from the reaction wall 142, while still providing the club head with the impact durability of a metal strike face 12. Additionally, by making a portion of the body 14 out of polymer, any additional weight incurred due to the presence of the reaction wall 142 might be offset by the comparatively lighter polymeric body portion.

In some embodiments, the polymeric body portion (i.e., the portion that is integral with the reaction wall 142) may be an injection molded component that is formed from a flowable thermoplastic material. In some embodiments, this thermoplastic material may comprise an engineering plastic such as polyphenylene sulfide (PPS) or a polyamide such as PA6 or PA66. PPS may be a preferred material due to its unique acoustic properties that have a metallic-like response. In some embodiments, the polymer may be a filled polymer, that may comprise a plurality of discontinuous glass, carbon, aramid, or PTFE fibers distributed throughout the component. In some embodiments, a different polymer may be co-molded and/or insert molded onto the reaction surface 44 to provide a lower-friction coating that promotes relative translation at impact. This polymer may include a polyoxymethylene (POM/Acetal), polytetrafluoroethylene (PTFE), PTFE filled Acetal, PPS and/or certain classes of polyamides such as PA6 or PA66, and may be similar to that described above with respect to FIG. 13.

In some embodiments, the polymeric body portion may instead be formed from a fiber-reinforced composite. Suitable fibers may comprise glass, carbon, or aramid fibers, and may extend continuously over large portions of the component. The fibers may be embedded in a polymer that may comprise a thermosetting resin, or a thermoplastic. In an embodiment where a low-friction polymer is used on the reaction surface 44, the polymer matrix of the component may be a thermoplastic that may include at least 5% of the base resin used to coat the reaction surface 44. Doing so may promote a durable adhesion between the low-friction coating and the reaction wall 142. In one embodiment, this base thermoplastic resin may comprise POM/Acetal, PPS and/or certain classes of polyamides such as PA6 or PA66.

Figure 17:
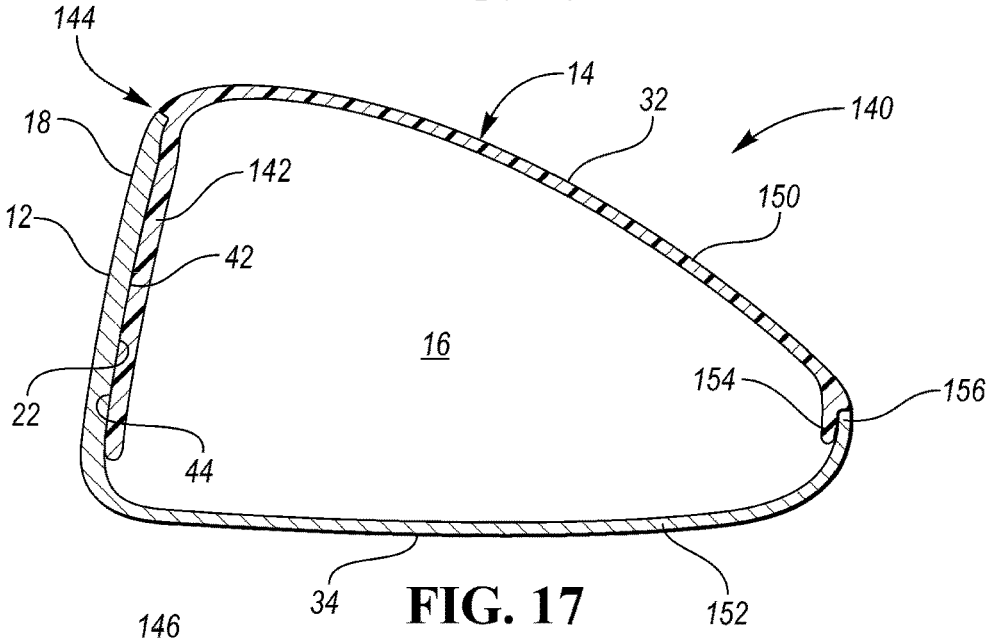
FIG. 17 is a schematic cross-sectional view of the golf club head of FIG. 16.
Figure 19:
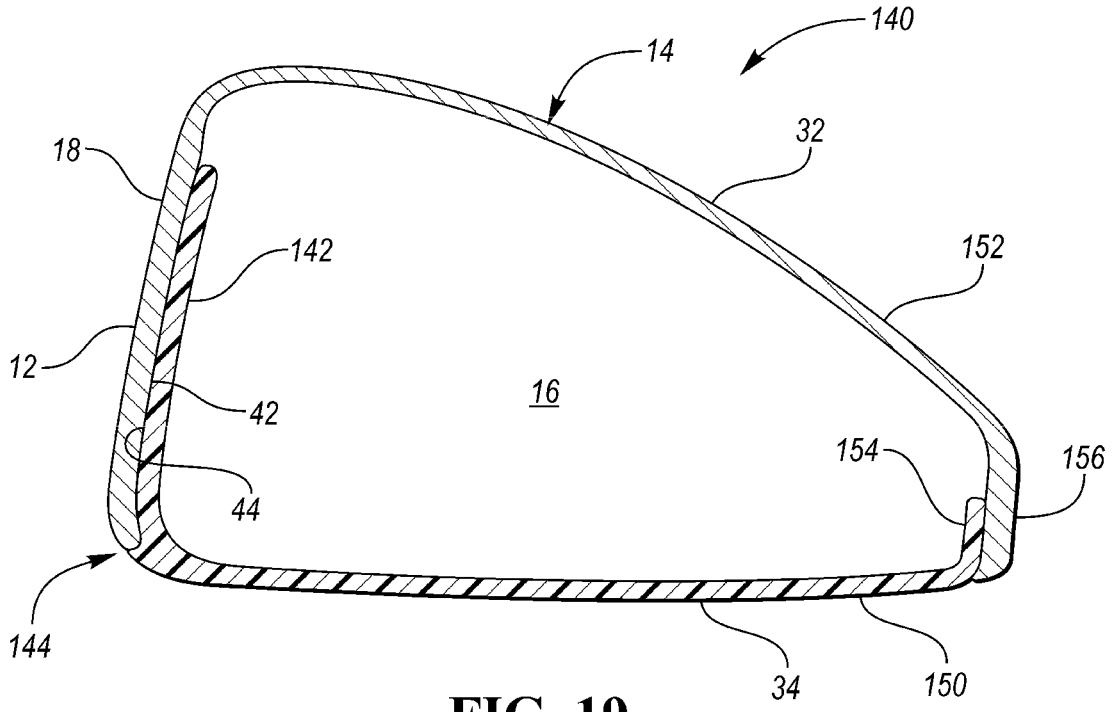
FIG. 19 is a schematic cross-sectional view of a golf club head having a polymeric sole and reaction wall, and a metallic crown and strike face.

As further shown in FIGS. 17 and 19, in some embodiments of this mixed material club head 140, the polymeric component 150 (i.e., comprising the reaction wall 142 and integrally formed body portion) may be nested within the outer metallic component 152 (i.e., comprising the strike face 12 and its integrally formed body portion). This nested relationship involves, among other things, inserting an outer wall 154 of the polymeric component 150 within a mating perimeter wall 156 of the metallic component 152. In this manner, when the reaction wall 142 is compressed inward by the strike face 12, the outer wall 154 of the polymeric component 150 may be constrained by the wall 156 of the metallic component 152, which may aid in restoring the face 12 after the initial impact compression. The polymeric component 150 may then be affixed to the metallic component 152, for example, via an adhesive disposed between the two components around a perimeter of the club head 10 where the crown 32 meets the sole 34 (i.e., where the polymeric component 150 is nested inside the metallic component 152). It is important that the adhesive, however, not be applied between the strike face 12 and the reaction wall 142, to allow these surfaces to translate at impact.

In each embodiment described above, the present designs may enable a face with unbalanced structural support. In doing so, the behavior of the face at impact may be tuned to adjust fade/draw tendencies, to increase or decrease the dynamic loft of the club head 10, or to increase or decrease the resulting ball spin following impact. Several of the embodiments incorporate discontinuities in the body 14 of the club head 10 that are angled through the thickness of the wall. In doing so, the two sides of the discontinuity (i.e., the impact side, and the reaction side) are encouraged to translate with respect to each other, while the contact force through the discontinuity also induces a transverse elastic deformation in the body 14. This response provides a tunable elastic face deformation that improves the efficiency of the impact while also adjusting the resultant launch of the impacted ball.

To properly realize the benefits (i.e., for the flexure joint to experience enough force/stress to respond as intended), the joint 40 is preferably located within about 40 mm of the strike face 12. If a polymer is used within the joint 40 to reduce friction and/or prevent galling, it is preferable for that polymer to have a hardness of at least about 50D, or at least about 60D, or more preferably at least about 70D, or even at least about 80D measured on the Shore D Hardness Scale according to ASTM D2240.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosures are set forth in the following clauses.

Clause 1: A hollow golf club head having an inner surface and an outer surface comprises a strike face operative to impact a golf ball, a body extending rearward from a perimeter of the strike face, and a flexure joint extending from the outer surface to the inner surface; the strike face locally displaces relative to a portion of the body in response to an impact between the strike face and the golf ball; and the flexure joint includes: a forward impact surface, and a reaction surface in contact with the impact surface; wherein, in response to the impact, the impact surface translates along the reaction surface and elastically displaces the reaction surface to permit an increased impact-induced displacement of the strike face.

Clause 2: The golf club head of clause 1, wherein the reaction surface applies a reaction force against the impact surface that is proportional to the amount of translation between the impact surface and the reaction surface.

Clause 3: The golf club head of any of clauses 1-2, wherein both the body and the strike face are at least partially formed from one or more metal alloys, and wherein at least one of the impact surface and the reaction surface is coated with a polymer.

Clause 4: The golf club head of clause 3, wherein the polymer includes at least one of polyoxymethylene and polytetrafluoroethylene.

Clause 5: The golf club head of any of clauses 1-4, wherein the strike face displacement decreases with an increasing distance from the flexure joint.

Clause 6: The golf club head of any of clauses 1-5, wherein the body defines a sole and a crown; and wherein flexure joint extends across a portion of the sole in a direction that is about parallel to the perimeter of the strike face.

Clause 7: The golf club head of any of clauses 1-5, wherein the body defines a sole and a crown; and wherein the flexure joint extends along a portion of the crown in a direction that is about parallel to the perimeter of the strike face.

Clause 8: The golf club head of any of clauses 1-7, wherein the reaction surface meets the outer surface at a location that is within about 40 mm of a plane defined by the strike face.

Clause 9: The golf club head of any of clauses 1-8, wherein the reaction surface meets the outer surface at an oblique angle.

Clause 10: The golf club head of any of clauses 1-9, further comprising a mechanical stop extending into the inner volume, wherein the mechanical stop is operative to limit the amount of allowable translation of the impact surface relative to the reaction surface.

Clause 11: The golf club head of clauses 1-2, wherein the strike face defines a ball striking surface and a rear surface that is opposite the ball striking surface; wherein the body includes a reaction wall that is in contact with the rear surface of the strike face; and wherein the rear surface of the strike face is the forward impact surface of the flexure joint, and wherein the reaction wall forms the reaction surface of the flexure joint.

Clause 12: The golf club head of clause 11, wherein the reaction wall is in contact with from about 30% to about 60% of the area of the rear surface.

Clause 13: The golf club head of any of clauses 11-12, wherein the body defines a crown and a sole; and wherein one of the crown and the sole is integrally formed with the strike face, and wherein the other one of the crown and the sole is integrally formed with the reaction wall.

Clause 14: The golf club head of any of clauses 11-13, wherein the reaction wall is formed from a polymeric material, and wherein the strike face is formed from a metallic material.

Clause 15: A mixed material golf club head comprises a strike face having a ball striking surface operative to impact a golf ball and a rear surface opposite the ball striking surface; a crown forming an upper portion of the golf club head; a sole forming a lower portion of the golf club head, the crown and sole defining an internal club head volume therebetween; and a reaction wall that is in flush contact with the rear surface of the strike face. One of the crown and the sole is integrally formed with the strike face, and the other one of the crown and the sole is integrally formed with the reaction wall; the strike face is formed from a metal; the reaction wall is formed from a polymer; and in response to an impact between the strike face and the golf ball, the rear surface of the strike face slidably translates along the reaction wall while maintaining flush contact.

Clause 16: The mixed material golf club head of clause 15, further comprising a first component that forms the strike face and a second component that forms the reaction wall; and wherein the first component is adhered to the second component around a perimeter of the club head where the crown meets the sole.

Clause 17: The mixed material golf club head of clause 16, wherein the second component is nested internally to the first component around the perimeter.

Clause 18: The mixed material golf club head of any of clauses 15-17, wherein a surface of the reaction wall in contact with the rear surface of the strike face is formed from a polymer that includes at least one of polyoxymethylene and polytetrafluoroethylene.

Clause 19: The mixed material golf club head of any of clauses 15-18, wherein the reaction wall is in contact with from about 30% to about 60% of the area of the rear surface.

Clause 20: The mixed material golf club head of any of clauses 15-19, wherein the strike face elastically displaces the reaction wall in response to the impact.

The invention claimed is:

1. A hollow golf club head, the golf club head comprising:

a strike face operative to impact a golf ball;

a body extending rearward from the perimeter of the strike face, wherein the strike face locally displaces relative to a portion of the body in response to an impact between the strike face and the golf ball; and a flexure joint comprising an impact surface and a reaction surface;

wherein the impact surface slides relative to the reaction surface in response to the impact;

wherein at least one of the impact surface and the reaction surface comprises a curvature;

wherein said curvature comprises a varying radius; and wherein the curvature of at least one of the impact surface and the reaction surface causes the flexure joint to become progressively stiffer with increasing deflection of the strike face and simultaneous translation of the reaction surface along the impact surface.

2. The hollow golf club head of claim 1, wherein the other of the impact surface and the reaction surface also comprises a curvature, and the curvature of the impact surface differs from the curvature of the reaction surface.

3. The hollow golf club head of claim 1, wherein the body defines a sole and a crown; and wherein the flexure joint extends across one of either a portion of the sole or a portion of the crown.

4. The hollow golf club head of claim 1, wherein the reaction surface meets the outer surface at a location that is within about 40 mm of a plane defined by the strike face.

5. The hollow golf club head of claim 1, wherein the impact surface elastically displaces the reaction surface to permit an increased impact-induced displacement of the strike face.

6. The hollow golf club head of claim 1, wherein the golf club head comprises an inner surface and an outer surface, the inner surface defines a cavity within the golf club head, and the flexure joint extends from the outer surface to the inner surface.

7. The hollow golf club head of claim 1, wherein the reaction surface applies a reaction force against the impact surface that is disproportional to the amount of translation between the impact surface and the reaction surface.

8. The hollow golf club head of claim 1, wherein both the body and the strike face are at least partially formed from one or more metal alloys, and wherein at least one of the impact surface and the reaction surface is coated with a polymer.

9. The hollow golf club head of claim 8, wherein the polymer includes at least one of polyoxymethylene and polytetrafluoroethylene.

10. The hollow golf club head of claim 1, wherein the impact surface comprises a first average radius of curvature and the reaction surface comprises a second average radius of curvature; and the first average radius of curvature is less than the second average radius of curvature.

11. The hollow golf club head of claim 1, wherein the reaction surface comprises a curvature that tightens with an increasing distance from the strike face.

12. The hollow golf club head of claim 1, wherein the impact surface comprises a first average radius of curvature and the reaction surface comprises a second average radius of curvature; and the first average radius of curvature is greater than the second average radius of curvature.

13. The hollow golf club head of claim 1, wherein the impact surface comprises a curvature that tightens with an increasing distance from the strike face.

14. A hollow golf club head, the golf club head comprising:

an inner surface and an outer surface, the inner surface defining an interior cavity;

a strike face operative to impact a golf ball;

a body extending rearward from the perimeter of the strike face, wherein the strike face locally displaces relative to a portion of the body in response to an impact between the strike face and the golf ball; the body comprising a sole and a crown;

a flexure joint comprising an impact surface and a reaction surface;

wherein the impact surface slides relative to the reaction surface in response to the impact;

wherein the portion of the impact surface and the portion of the reaction surface slope at an angle of between 30 degrees and 70 degrees from a plane tangent to the outer surface at the flexure joint; and wherein at least a portion of the impact surface and at least a portion of the reaction surface slope from the outer surface towards the strike face.

15. The hollow golf club head of claim 14, wherein the flexure joint extends across one of either a portion of the sole or a portion of the crown.

16. The hollow golf club head of claim 14, wherein the flexure joint extends from the outer surface to the inner surface.

17. The hollow golf club head of claim 14, wherein at least a second portion of one or more of the impact surface and the reaction surface comprises a curvature.

* * * * *